US009538822B2

(12) United States Patent
Chen

(10) Patent No.: US 9,538,822 B2
(45) Date of Patent: Jan. 10, 2017

(54) HAIR STYLING TOOL

(71) Applicant: YUMARK ENTERPRISES CORP., Taipei (TW)

(72) Inventor: Ming-Hung Chen, Taipei (TW)

(73) Assignee: YUMARK ENTERPRISES CORP., Taipei (TW)

( * ) Notice: Subject to any disclaimer, the term of this patent is extended or adjusted under 35 U.S.C. 154(b) by 84 days.

(21) Appl. No.: 14/628,226

(22) Filed: Feb. 21, 2015

(65) Prior Publication Data

US 2016/0242523 A1 Aug. 25, 2016

(51) Int. Cl.

| | |
|---|---|
| ***A41G 5/00*** | (2006.01) |
| ***A45D 8/38*** | (2006.01) |
| ***A45D 8/34*** | (2006.01) |
| *A45D 8/00* | (2006.01) |

(52) U.S. Cl.

CPC . *A45D 8/38* (2013.01); *A45D 8/34* (2013.01); *A45D 2008/004* (2013.01)

(58) Field of Classification Search

CPC ..... A45D 8/00; A45D 8/12; A45D 8/14; A45D 8/16; A45D 8/34; A45D 8/38; A45D 8/40; A45D 2008/002; A45D 2008/004; A45D 2008/006

See application file for complete search history.

(56) References Cited

U.S. PATENT DOCUMENTS

| | | | | | |
|---|---|---|---|---|---|
| 961,323 | A * | 6/1910 | Stacy | A45D 8/12 | 132/106 |
| 2,668,547 | A * | 2/1954 | Wille | A45D 8/34 | 132/273 |
| 4,998,186 | A * | 3/1991 | Cocca | A44C 15/0015 | 132/275 |
| 2011/0284022 | A1* | 11/2011 | Masaki | A45D 8/00 | 132/275 |
| 2013/0298928 | A1* | 11/2013 | Askander | A45D 8/12 | 132/144 |
| 2014/0202482 | A1* | 7/2014 | Didieu | A45D 8/00 | 132/200 |
| 2015/0335123 | A1* | 11/2015 | Chen | A45D 8/36 | 132/275 |

* cited by examiner

*Primary Examiner* — Rachel Steitz

(74) *Attorney, Agent, or Firm* — Li & Cai Intellectual Property (USA) Office

(57) ABSTRACT

The present disclosure provides a hair styling tool for padding a hair bundle, comprising: a base, an elastic padding, an adornment structure, and a contact layer. The base has an upper surface, a lower surface, and an opening passing from the upper surface to the lower surface. The elastic padding is disposed on a portion of the upper surface of the base. The adornment structure is disposed on another portion of the upper surface of the base. The contact layer is disposed on the lower surface of the base. A first hair section of the hair bundle covers the elastic padding and is padded thereby. A second hair section of the hair bundle passes through the opening and is pressed by the contact layer, such that the adornment structure is exposed above the second hair section.

15 Claims, 7 Drawing Sheets

HAIR STYLING TOOL

BACKGROUND OF THE INVENTION

1. Field of the Invention

The present disclosure relates to a hair styling tool; in particular, which increases hair volume.

2. Description of Related Art

With the passing of time, hair styling tools have become widespread and diverse. In order to meet different needs of hairstylists, hair styling tools are made to meet professional, aesthetic, and practical needs, and are easy to use for achieving styling effects. Typical hairstyles for formal occasions include bundling hair into a bun. Common hair styling tools are placed underneath the hair for padding, fixed by some method, and then parts of the hair styling tools are concealed by careful handling from the hairstylists. However, these hair styling tools often use elastic bands to fix the hair. Elastic bands need to be concealed for aesthetic purposes. Moreover, elastic bands can cause discomfort to the user. A conventional soft pad is a hair styling tool for padding hair, and likewise cannot tie the hair together and has the abovementioned deficiencies.

SUMMARY OF THE INVENTION

The object of the present disclosure is to provide a hair styling tool which can increase hair volume.

In order to achieve the aforementioned objects, a first embodiment of the present disclosure provides a hair styling tool for increasing hair volume comprising: a base, an elastic padding, an adornment structure, and a contact layer. The base has an upper surface, a lower surface opposite the upper surface, and an opening passing from the upper surface to the lower surface. The elastic padding is disposed on a portion of the upper surface of the base. The adornment structure is disposed on another portion of the upper surface of the base. The contact layer is disposed on the lower surface of the base. A first hair section of a bundle of hair covers the elastic padding and is padded thereby. A second hair section of the bundle of hair passes through the opening and is pressed by the contact layer, such that the adornment structure is exposed above the second hair section.

A second embodiment of the present disclosure provides a hair styling tool for increasing hair volume comprising: a base, an elastic padding, an adornment structure, and a contact layer. The second embodiment is different from the first embodiment in that: a first hair section of the hair bundle covers the elastic padding and is padded thereby; a second hair section of the bundle of hair passes through the opening and is pressed by the contact layer; the second hair section merges with an under layer of hair to form a remaining hair bundle which is inserted into the opening from above, wherein a portion of the remaining hair bundle is inserted into the opening, and another portion of the remaining hair bundle is still exposed.

A third embodiment of the present disclosure provides a hair styling tool for increasing hair volume comprising: a base, an elastic padding, an adornment structure, and a contact layer. The third embodiment is different from the first embodiment in that: a first hair section of the hair bundle covers the elastic padding and is padded thereby; a second hair section of the bundle of hair passes through a first opening and is pressed by the contact layer, such that the adornment structure and a second opening is exposed above the second hair section; the second hair section merges with an under layer of hair to form a remaining hair bundle which is inserted into the second opening from above, wherein a portion of the remaining hair bundle is inserted into the second opening, and another portion of the remaining hair bundle and the adornment structure are still exposed.

The present disclosure has the following advantages. A hair styling tool which can fasten hair without using elastic bands is provided. Hair can be padded by the elastic padding, and styled thereon by using adornment or hair pins on the elastic padding for fixing the hair style. Particularly, up-dos can be done quickly and simply.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment

Figure 1:
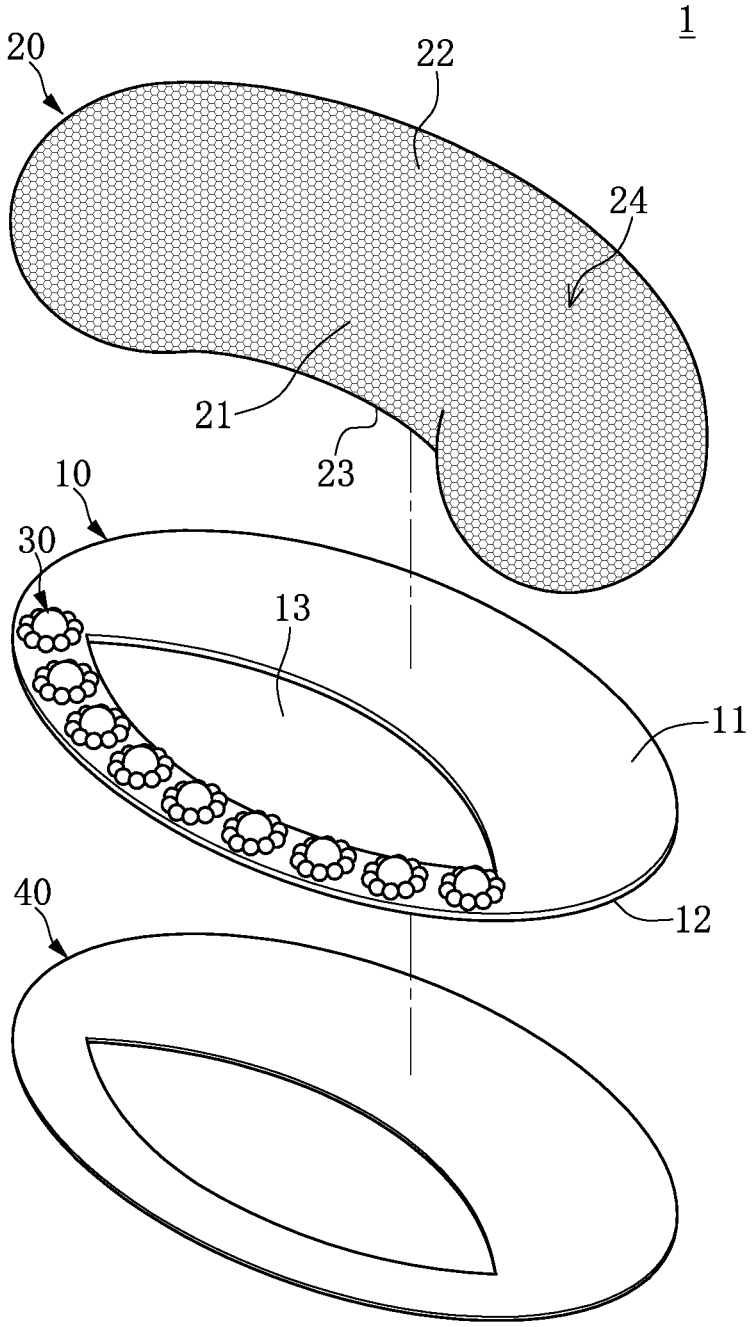
FIG. 1 shows an exploded view of a hair styling tool according to a first embodiment of the present disclosure.
Figure 2:
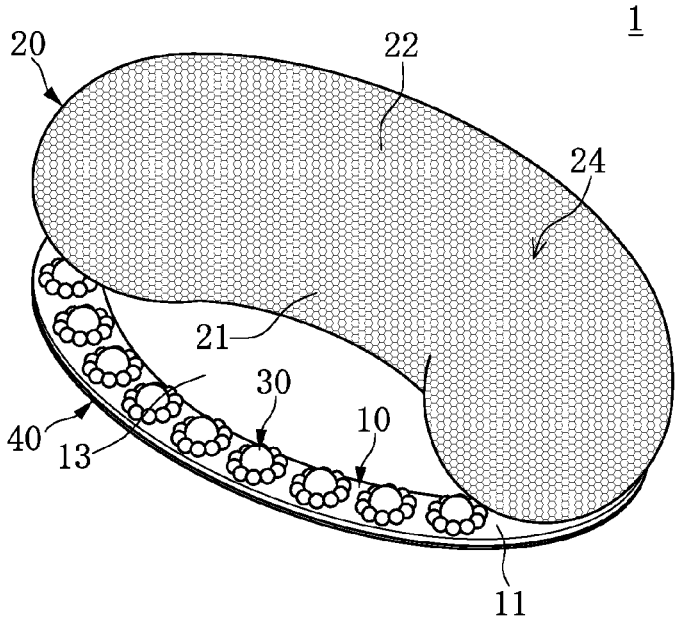
FIG. 2 shows a perspective view of an assembled hair styling tool according to a first embodiment of the present disclosure.
Figure 3:
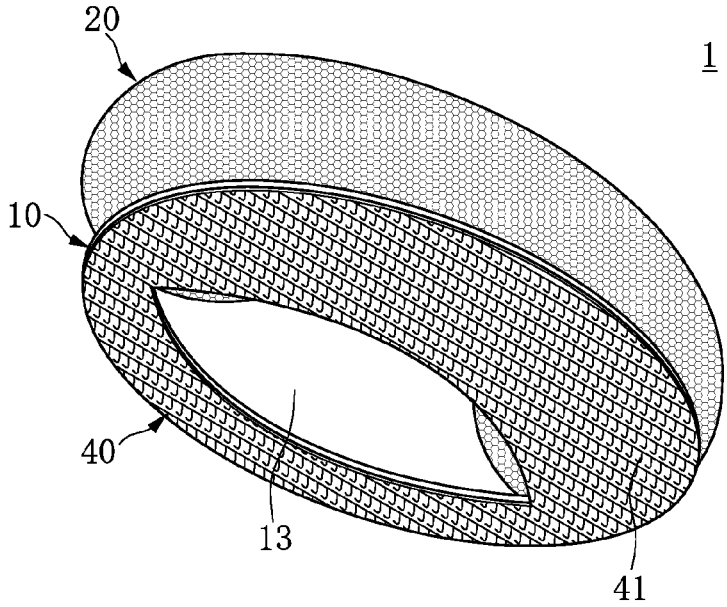
FIG. 3 shows another perspective of a hair styling tool according to a first embodiment of the present disclosure.

FIG. 1 shows an exploded view of a hair styling tool 1 according to a first embodiment of the present disclosure. FIG. 2 shows a perspective view of an assembled hair styling tool 1 according to a first embodiment of the present disclosure. FIG. 3 shows another perspective of a hair styling tool 1 according to a first embodiment of the present disclosure. The present disclosure provides a hair styling tool 1 comprising: a base 10, an elastic padding 20, an adornment structure 30, and a contact layer 40.

Specifically, the base 10 has an upper surface 11, a lower surface 12 opposite the upper surface 11, and an opening 13 passing from the upper surface 11 to the lower surface 12. The elastic padding 20 has a front edge 21, an upper edge 22, and a lower edge 23. The elastic padding 20 is disposed on a portion of the upper surface 11 of the base 10, which is joined to the lower edge 23 of the elastic padding 20. The adornment structure 30 is disposed on another portion of the upper surface 11 of the base 10. The contact layer 40 has an opening 13 and is disposed on the lower surface 12 of the base 10.

The elastic padding 20 disposed on a portion of the upper surface 11 of the base 10 is made of nylon fibers or a foam material and has a plurality of holes 24. The elastic padding 20 is made by weaving nylon fibers into a web shape, and then rolled into a column shaped or rectangular body, forming the elastic padding 20. The elastic padding 20 can be covered by a decorative layer, the color of which can be chosen to match the user's hair. The elastic padding 20 is flexible, and can be bent according to the shape of the user's head. For example, the dimensions of the elastic padding 20 can be proportional to the dimensions of the base 10. For example, when the user has sparse hair, the elastic padding 20 can be bigger to account for more hair volume and increase aesthetic appearance. Additionally, the elastic padding 20 has a plurality of holes 24 for decorative accessories or hair pins to be inserted therein. Moreover, the adornment structure 30 is disposed on another portion of the upper surface 11 of the base 10. The adornment structure 30 can be adorned by sequins, jewelry, flowers or knots, or an LED adornment design. Typically the design of the adornment structure 30 is done by the manufacturer and the user does not need to adjust the design. The contact layer 40 is disposed on the lower surface 12 of the base 10. The contact layer 40 can be Velcro®, or a groove structure with a plurality of engagement units for attachment to hair. Therefore, the contact layer 40 includes a hook section 41 for attachment to hair. The opening 13 of the contact layer 40 can be circular, elliptical, rectangular, jaw shaped, or other irregular shapes.

Figure 4:
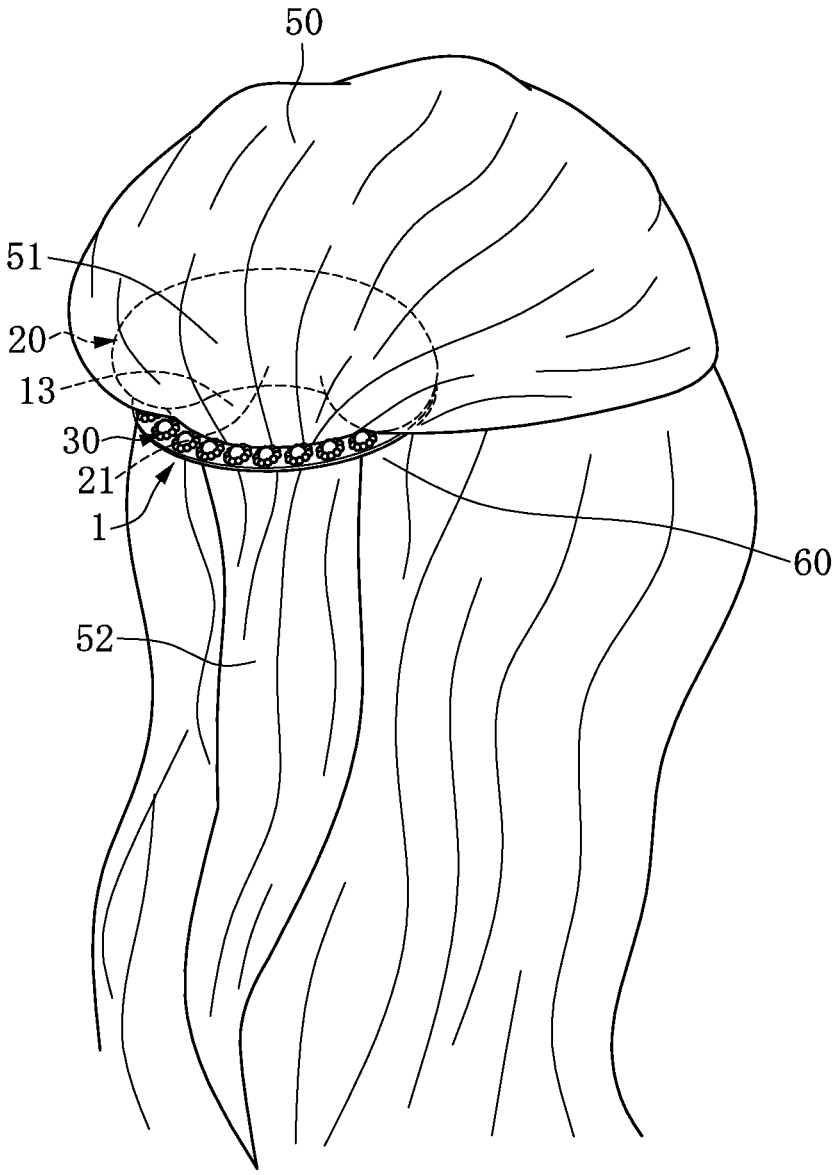
FIG. 4 shows a hair styling tool during application according to a first embodiment of the present disclosure.
Figure 5:
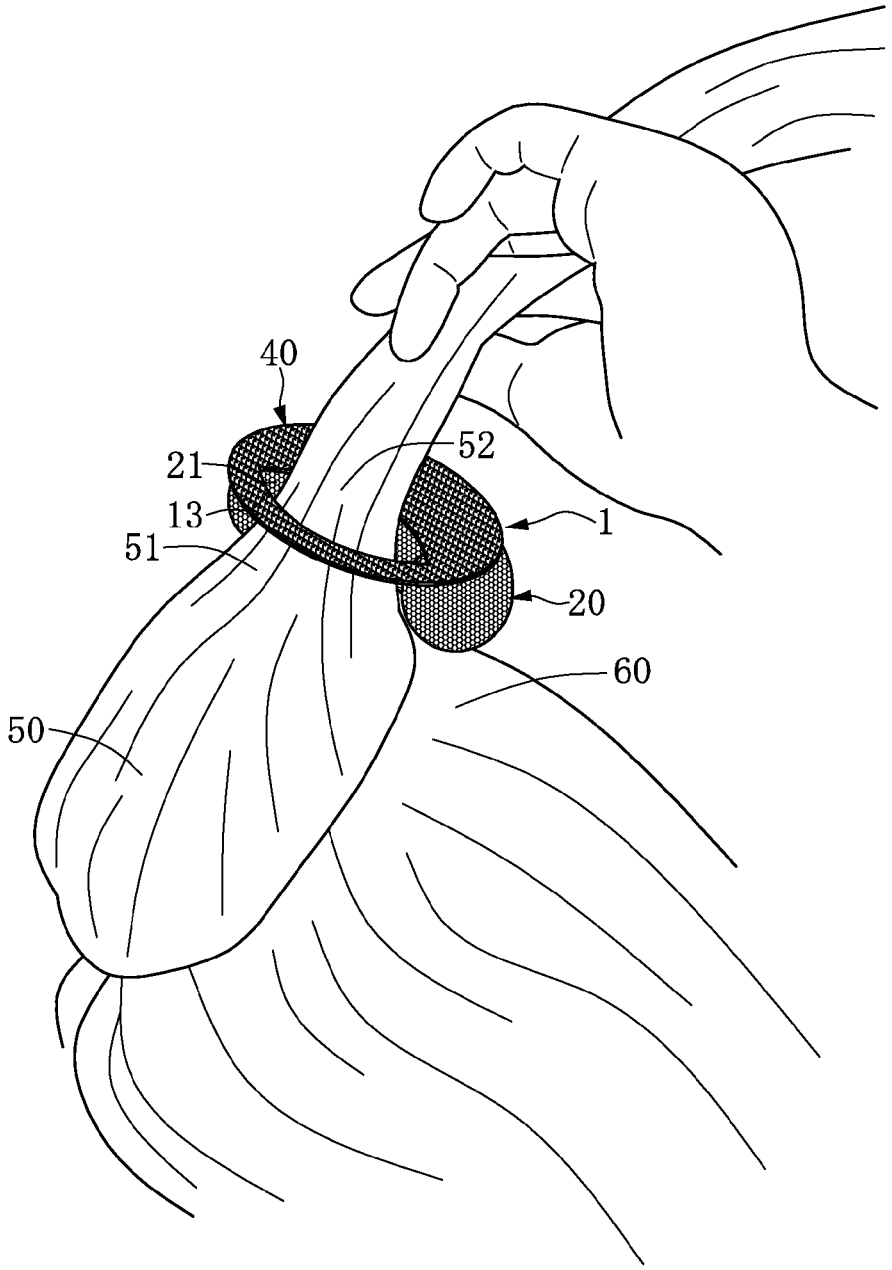
FIG. 5 shows a hair styling tool during application according to a first embodiment of the present disclosure.

Referring to FIG. 4 and FIG. 5, during application a portion of the user's hair is defined as an upper hair bundle 50, and another portion of the user's hair is defined as an under layer of hair 60. At first the Velcro® faces upward, and the upper hair bundle 50 passes through the opening 13 of the base 10, such that the front edge 21 of the elastic padding 20 faces toward the user's forehead and contacts the upper hair bundle 50. Then, the hair styling tool 1 is turned such that the front edge 21 of the elastic padding 20 faces away from the user's head. At this moment, the elastic padding 20 is arranged between the upper hair bundle 50 and the under layer of hair 60, and the Velcro® of the contact layer 40 is attached to the under layer of hair 60. Therefore, the elastic padding 20 can pad the upper hair bundle 50, and be completely concealed between the upper hair bundle 50 and the under hair layer 60, and the adornment structure 30 is exposed above the upper hair bundle 50, and the contact layer 40 is attached to the under layer of hair 60, such that the entire hair styling tool 1 is securely fixed on the hair.

In other words, a first hair section 51 of the upper hair bundle 50 is padded by the elastic padding 20, and a second hair section 52 of the upper hair bundle 50 passes through the opening 13 and is pressed by the contact layer 40, such that the adornment structure 30 is exposed above the second hair section 52. The hair styling tool 1 is securely fastened in the hair.

Second Embodiment

Figure 6:
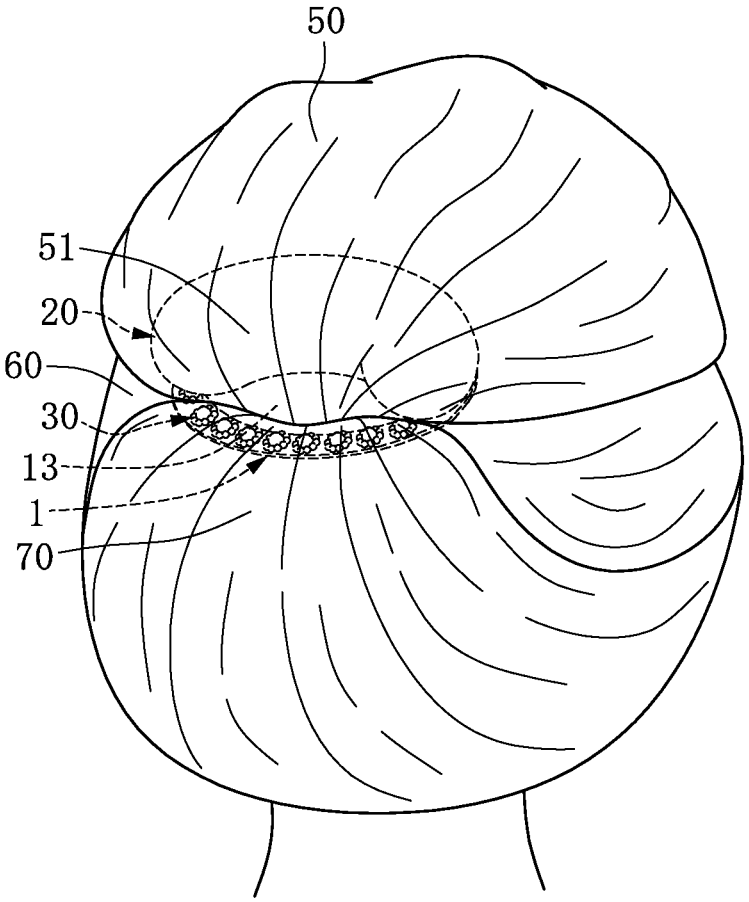
FIG. 6 shows a hair styling tool during application according to a second embodiment of the present disclosure.

FIG. 6 shows a hair styling tool 1 during application according to a second embodiment of the present disclosure. The greatest difference between the second embodiment and the first embodiment lies in that in the second embodiment: during application a portion of the user's hair is defined as an upper hair bundle 50, and another portion of the user's hair is defined as an under layer of hair 60; at first the Velcro® faces upward, and the upper hair bundle 50 passes through the opening 13 of the base 10, such that the front edge 21 of the elastic padding 20 faces toward the user's forehead and contacts the upper hair bundle 50; then, the hair styling tool 1 is turned such that the front edge 21 of the elastic padding 20 faces away from the user's head; at this moment, the elastic padding 20 is arranged between the upper hair bundle 50 and the under layer of hair 60, and the Velcro® of the contact layer 40 is attached to the under layer of hair 60; therefore, the elastic padding 20 can pad the upper hair bundle 50, and be completely concealed between the upper hair bundle 50 and the under hair layer 60, and the adornment structure 30 is exposed above the upper hair bundle 50, and the contact layer 40 is attached to the under layer of hair 60, such that the entire hair styling tool 1 is securely fixed on the hair; finally the second hair section 52 merges with the under layer of hair 60 to form a remaining hair bundle 70 which is inserted into the opening 13 from above, forming an up-do.

Third Embodiment

Figure 7:
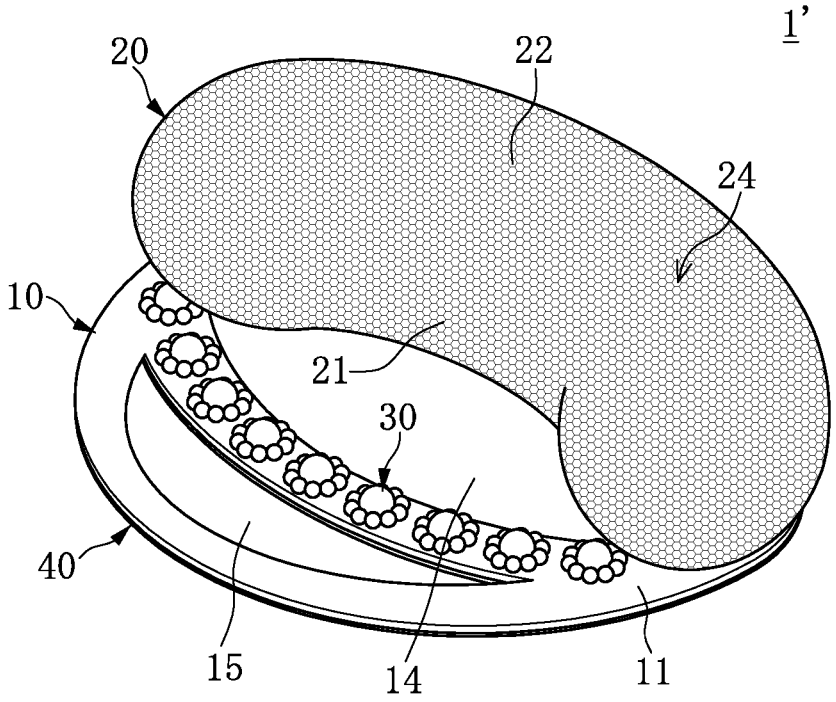
FIG. 7 shows a perspective view of an assembled hair styling tool according to a third embodiment of the present disclosure.
Figure 8:
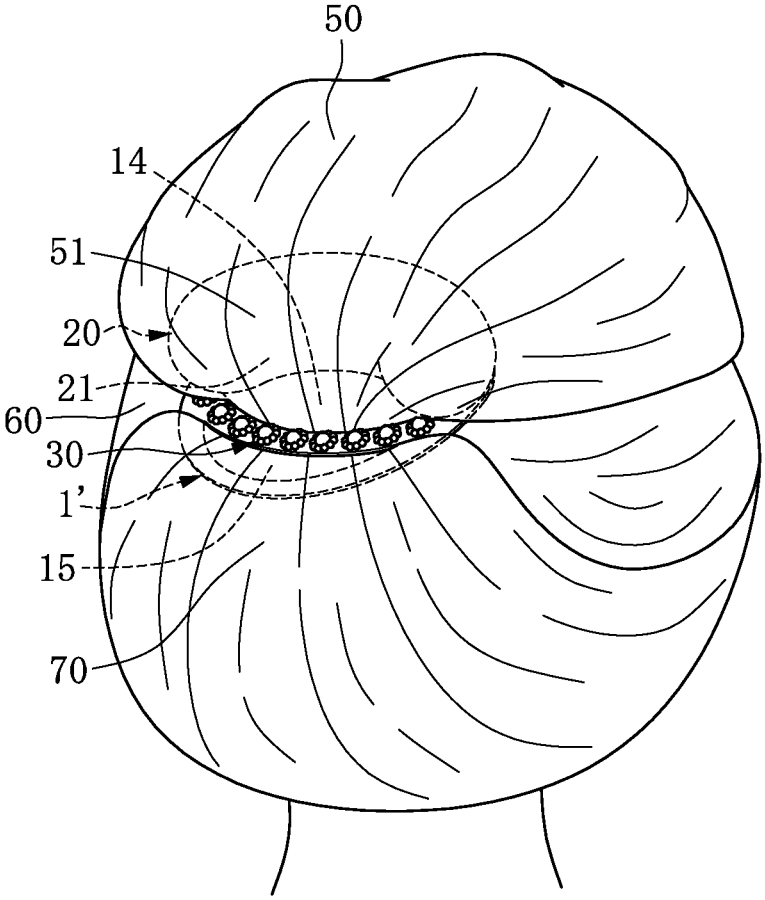
FIG. 8 shows a hair styling tool during application according to a third embodiment of the present disclosure.

FIG. 7 shows a perspective view of an assembled hair styling tool 1' according to a third embodiment of the present disclosure. FIG. 8 shows a hair styling tool 1' during application according to a third embodiment of the present disclosure. The hair styling tool 1' comprises: a base 10, an elastic padding 20, an adornment structure 30, a contact layer 40, a first opening 14, and a second opening 15.

The greatest difference between the third embodiment and the first embodiment lies in that in the third embodiment: the adornment structure 30 is disposed on a portion of the upper surface 11 of the base 10, and the elastic padding 20 is disposed on another portion of the upper surface 11 of the base 10; the contact layer 40 has the first opening 14 and the second opening 15; during application a portion of the user's hair is defined as an upper hair bundle 50, and another portion of the user's hair is defined as an under layer of hair 60; at first the Velcro® faces upward, and the upper hair bundle 50 passes through the first opening 14 of the base 10, such that the front edge 21 of the elastic padding 20 faces toward the user's forehead and contacts the upper hair bundle 50; then, the hair styling tool 1' is turned such that the front edge 21 of the elastic padding 20 faces away from the user's head; at this moment, the elastic padding 20 is arranged between the upper hair bundle 50 and the under layer of hair 60, and the Velcro® of the contact layer 40 is attached to the under layer of hair 60; therefore, the elastic padding 20 can pad the upper hair bundle 50, and be completely concealed between the upper hair bundle 50 and the under hair layer 60, and the adornment structure 30 and the second opening 15 are exposed above the second hair section 52; finally the second hair section 52 merges with the under layer of hair 60 to form a remaining hair bundle 70 which is inserted into the second opening 15 from above, forming an up-do.

In other words, a first hair section 51 of the upper hair bundle 50 is padded by the elastic padding 20, and a second hair section 52 of the upper hair bundle 50 passes through the first opening 14 and is pressed by the contact layer 40, such that the adornment structure 30 and a portion of the base 10 including the second opening 15 are exposed above the second hair section 52. Then, a remaining hair bundle 70 formed by merging the second hair section 52 and the under layer of hair 60 is inserted into the second opening 15 from above. A portion of the remaining hair bundle 70 is inserted into the second opening 15, and another portion of the remaining hair bundle 70 and the adornment structure 30 are still exposed, forming an up-do. The hair styling tool 1' is securely fastened in the hair.

In summary of the above, the present disclosure has the following advantages. The hair styling tool 1 of the present disclosure can pad and bundle hair without using elastic bands. Hairpins can be inserted into the hair styling tool 1 to secure designs. The contact layer 40 can secure the hair design onto the head. The adornment structure 30 serves aesthetic purposes. Up-dos can be done simply and quickly.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A hair styling tool for padding a hair bundle, comprising:

a base having an upper surface, a lower surface opposite the upper surface, and an opening passing from the upper surface to the lower surface, wherein the shape of the base is sheet type;

an elastic padding having a front edge, an upper edge, and a lower edge, wherein the elastic padding disposed on a portion of the upper surface of the base, which is joined to the lower edge of the elastic padding;

an adornment structure disposed on another portion of the upper surface of the base; and a contact layer disposed on the lower surface of the base, wherein the contact layer includes a hook section;

wherein the opening is located between the elastic padding and the adornment structure;

wherein in use a first hair section of the hair bundle covers the front edge and the upper edge of the elastic padding and the elastic padding is padded thereby, a second hair section of the hair bundle passes through the opening and is pressed by the contact layer, and the adornment structure is exposed above the second hair section.

2. The hair styling tool according to claim 1, wherein the elastic padding is column shaped or rectangular.

3. The hair styling tool according to claim 1, wherein the elastic padding has a plurality of holes.

4. The hair styling tool according to claim 1, wherein the opening is flat and elongated.

5. The hair styling tool according to claim 1, wherein the adornment structure is adorned by a type of decoration selected from the group consisting of sequins, jewelry, flowers and knots.

6. The hair styling tool according to claim 1, wherein the adornment structure is an LED unit.

7. The hair styling tool according to claim 1, wherein the adornment structure is made of a material selected from the group consisting of glitter leather, felt, fabric, POM POM cord, pearl, suede, PU, metal, plastic, wig, sequin, and stone.

8. A hair styling tool for padding a hair bundle, comprising:

a base having an upper surface, a lower surface opposite the upper surface, and an opening passing from the upper surface to the lower surface, wherein the shape of the base is sheet type;

an elastic padding having a front edge, an upper edge, and a lower edge, wherein the elastic padding disposed on a portion of the upper surface of the base, which is joined to the lower edge of the elastic padding;

an adornment structure disposed on another portion of the upper surface of the base; and a contact layer disposed on the lower surface of the base, wherein the contact layer includes a hook section;

wherein the opening is located between the elastic padding and the adornment structure;

wherein in use a first hair section of the hair bundle covers the front edge and the upper edge of the elastic padding and the elastic padding is padded thereby, a second hair section of the hair bundle passes through the opening and is pressed by the contact layer, the adornment structure and the opening are exposed above the second hair section, the second hair section merges with an under layer of hair to form a remaining hair bundle, the remaining hair bundle is inserted into the opening from above, a portion of the remaining hair bundle is inserted into the opening, and another portion of the remaining hair bundle is exposed.

9. A hair styling tool for padding a hair bundle, comprising:

a base having an upper surface, a lower surface opposite the upper surface, a first opening, and a second opening, the first opening and the second opening are passing from the upper surface to the lower surface, wherein the shape of the base is sheet type;

an elastic padding having a front edge, an upper edge, and a lower edge, wherein the elastic padding disposed on a portion of the upper surface of the base, which is joined to the lower edge of the elastic padding;

an adornment structure disposed on another portion of the upper surface of the base; and a contact layer disposed on the lower surface of the base, wherein the contact layer includes a hook section;

wherein the first opening is located between the elastic padding and the adornment structure, the adornment structure is located between the first opening and the second opening;

wherein in use a first hair section of the hair bundle covers the front edge and the upper edge of the elastic padding and the elastic padding is padded thereby, a second hair section of the hair bundle passes through the first opening and is pressed by the contact layer, the adornment structure and the second opening are exposed above the second hair section, the second hair section merges with an under layer of hair to form a remaining hair bundle, the remaining hair bundle is inserted into the second opening from above, a portion of the remaining hair bundle is inserted into the second opening, and another portion of the remaining hair bundle and the adornment structure are exposed.

10. The hair styling tool according to claim 9, wherein the elastic padding is column shaped or rectangular.

11. The hair styling tool according to claim 9, wherein the elastic padding has a plurality of holes.

12. The hair styling tool according to claim 9, wherein the opening is flat and elongated.

13. The hair styling tool according to claim 9, wherein the adornment structure is adorned by a type of decoration selected from the group consisting of sequins, jewelry, flowers and knots.

14. The hair styling tool according to claim 9, wherein the adornment structure is an LED unit.

15. The hair styling tool according to claim 9, wherein the adornment structure is made of a material selected from the group consisting of glitter leather, felt, fabric, POM POM cord, pearl, suede, PU, metal, plastic, wig, sequin, and stone.

* * * * *